United States Patent [19]

Knowlton

[11] Patent Number: 4,805,674

[45] Date of Patent: Feb. 21, 1989

[54] NATURAL GAS STORAGE AND RETRIEVAL SYSTEM

[75] Inventor: Robert E. Knowlton, Tsawwassen, Canada

[73] Assignee: C-I-L Inc., North York, Canada

[21] Appl. No.: 97,053

[22] Filed: Sep. 16, 1987

[51] Int. Cl.[4] ..... B65B 31/00

[52] U.S. Cl. ..... 141/47; 141/39

[58] Field of Search ..... 141/4, 5, 6, 7, 39, 141/40, 47, 100

[56] References Cited

U.S. PATENT DOCUMENTS

| | | | |
|---|---|---|---|
| 3,282,305 | 11/1966 | Antolak | 141/39. X |
| 3,812,888 | 5/1974 | Dalton | 141/39 |
| 4,583,346 | 4/1986 | Kameda | 141/6 X |
| 4,585,039 | 4/1986 | Hamilton | 141/47 |
| 4,589,453 | 5/1986 | Weiss | 141/39 |

*Primary Examiner*—Donald Watkins

*Attorney, Agent, or Firm*—C. Brian Barlow

[57] ABSTRACT

A natural gas storage and retrieval system which comprises natural gas storage means adapted to receive and store natural gas under pressure and a natural gas displacing liquid under pressure; means for feeding natural gas under pressure to said natural gas storage means whereby said stored displacing fluid is displaced; means for feeding said displacing liquid under pressure to said natural gas storage means whereby said stored natural gas is displaced; and means for collecting said displaced natural gas. The system provides a fast fill compressed natural gas station in which the storage inventory is significantly reduced with consequent improvement in environmental safety.

2 Claims, 1 Drawing Sheet

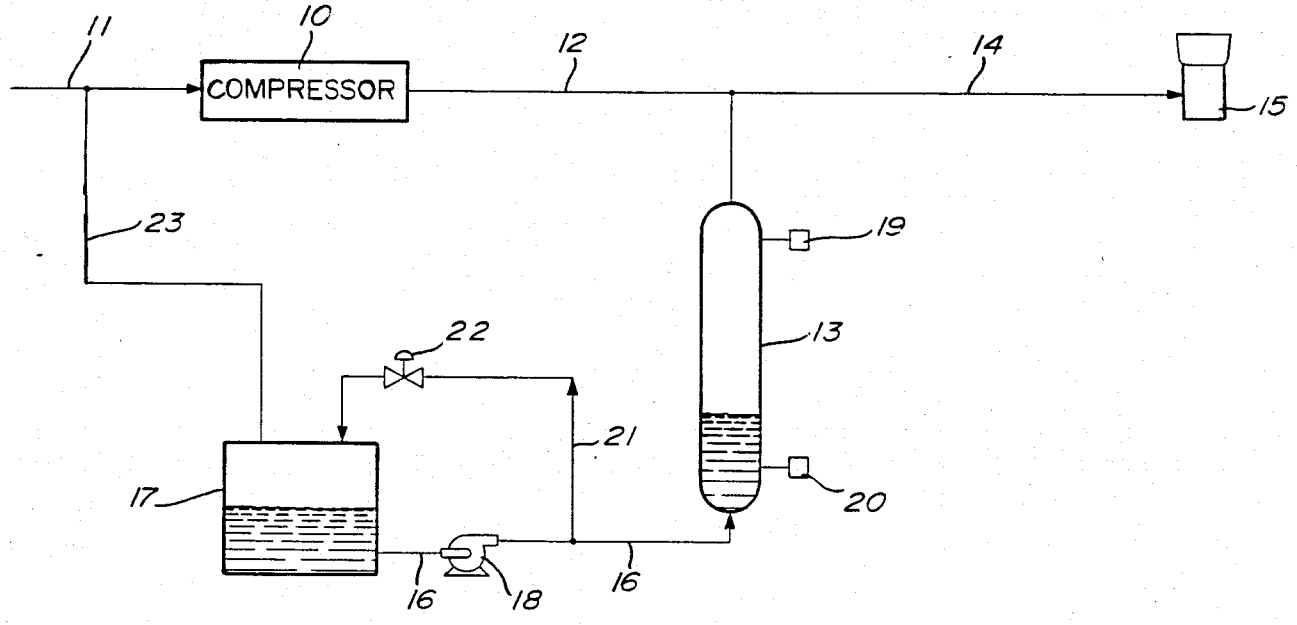
COMPRESSOR
10
11
12
13
14
15
16
16
17
18
19
20
21
22
23

NATURAL GAS STORAGE AND RETRIEVAL SYSTEM

This invention relates to a gas storage and retrieval system for use with a natural gas utility dispensing system.

Compressed natural gas is being used increasingly as a substitute for gasoline for use in motor vehicles. The vehicles are fitted with a compressed gas cylinder connected to the engine and the cylinder filled at filling stations. These stations are generally combined with gasoline filling facilities and are thus typically located in residential areas.

Two types of compressed natural gas filling stations are presently in use—one utilizing a "slow fill" system and the other a "fast fill" system.

Slow fill type filling stations are commonly used by fleet car operators when the vehicles are available for refilling for an extended period, e.g. overnight. In this system, gas is fed from the utility gas supply at a pressure of typically 20–60 psig, compressed and delivered at up to 3600 psig to stations having multiple filling delivery connections. The delivery connections are connected with high pressure hoses to the storage cylinder of the vehicle, which when full contains gas at a pressure of approximately 3000 psig.

Fast fill type filling stations are typically provided for retail use and provide compressed natural gas on demand so that a refilling period of typically 3–4 minutes is normal. Gas from the utility gas supply is compressed and fed to a diverter which allows the gas to be directed to either storage or a filing station. The diverter also allows stored gas to flow from storage to the filling station.

The storage pressure is maintained typically between 3200 psig and 3600 psig by the compressor, with compressor start initiated at the lower pressure and the compressor stop by the higher pressure. If during filling the pressure in the line from diverter to filling station drops below approximately 3200 psig the diverter will direct gas directly via the lines from the compressor through the diverter to the filling station. If the pressure in this line is above approximately 3200 psig, lines are interconnected via the diverter so that the filling station is connected to both storage and the compressor.

The filling stations are connected to the storage cylinder of the vehicles by high pressure hoses.

Thus, it can be seen that the primary advantage of the fast fill system over the slow fill system is the short time period of 3–4 minutes required to fill a vehicle. This short period is obtained by storing pressurized gas above the cylinder filling pressure.

A typical vehicle storage cylinder will contain, when full, approximately 2 cubic feet of compressed gas at 3000 psig. The storage cylinders provided at the filling station typically provide 80 cubic feet of compressed gas at approximately 3600 psig. During vehicle filling, with the compressor not in operation, the pressure in the storage cylinder may fall to 3000 psig and still fill the vehicle. However, if the storage cylinder pressure falls below this pressure it is not possible to completely fill the vehicle cylinder. Thus, the inventory in storage is represented by the gas volume available from lowering the storage pressure from its operating value to approximately 3000 psig. As illustrated below, the gas volume available represents only approximately 13% of the total stored gas volume. The balance is unused.

Volume of storage 80 $ft^3$.

Volume of gas calculated at atmospheric pressure in cylinder when compressed to 3600 psig is approximately 23,000 $ft^3$.

Volume of gas measured at atmospheric pressure in cylinder when compressed to 3000 psig is approximately 20,000 $ft^3$.

Thus, gas available for delivery is approximately 3,000 $ft^3$ or approximately 13% of the full storage volume.

Compressed natural gas is flammable in concentrations of 5 to 15% in air and the mixture is easily ignited. The unusable inventory in the storage container, thus, represents a very large ignitable gas volume in the event of accidental depressurization of the storage container to atmosphere and, as hereinabove mentioned, since filling stations are frequently located in residential areas, this unused inventory of natural gas represents a potentially hazardous material.

It is thus an object of the present invention to provide a fast fill compressed natural gas filling station in which the storage inventory provided is significantly reduced, with consequent improvement in environmental safety.

It is a further object of the invention to provide a system wherein the total inventory of natural gas in the storage vessel is available for use.

Thus, the invention provides a natural gas storage and retrieval system comprising:

(a) natural gas storage means adapted to receive and store natural gas under presure and a natural gas displacing liquid under pressure;

(b) means for feeding natural gas under pressure to said natural gas storage means whereby said stored displacing fluid is displaced;

(c) means for feeding said displacing liquid under pressure to said natural gas storage means whereby said stored natural gas is displaced; and (d) means for collecting said displaced natural gas.

In a preferred aspect the invention provides a system as hereinbefore defined wherein said means for feeding said displacing liquid to said storage means comprises liquid storage means and means for feeding said liquid under pressure to said natural gas storage means from said liquid storage means.

In order that the invention may be better understood a preferred embodiment will now be described by way of example only with reference to the accompanying drawing which shows schematically a natural gas storage and retrieval system according to the invention.

In this embodiment, a compressed liquid is used to displace gas from storage to a filling station.

The drawing shows a compressor 10 for feeding natural gas under pressure having a utility feed line 11 from a natural gas utility (not shown) and a delivery line 12 to a storage unit 13. Delivery line 12 continues as line 14 to a filling dispenser 15.

Connected to storage unit 13 by line 16 is a reservoir 17 which holds natural gas and a natural gas displacing liquid suitable for pumping and which is compatible with the preferred carbon steel equipment used in the storage means 13. In the embodiment described herein a suitable liquid is a 50% w/w ethylene glycol-water mixture which is commonly available commercially with suitable corrosion inhibitors. Within line 16 is a pump 18 used as a means for feeding the displacing liquid from reservoir 17 to storage unit 13.

Storage unit 13 is provided with an upper and a lower liquid level sensing switches 19 and 20, respectively.

Line 16 is also connected to reservoir 17 between storage unit 13 and pump 18 by means of line 21, which is fitted with valve 22.

Reservoir 17 is connected via vent line 23 to utility feed line 11 which thus causes reservoir 17 to be maintained at the utility gas pressure.

In operation gas from the utility, at typically, 20–60 psig flows to compressor 10 along line 11. It is compressed and transferred to storage unit 13 along line 12. Gas from storage unit 13 is delivered to station filling dispenser 15 through line 14 upon demand.

The gas pressure in storage is maintained by the transfer of liquid from reservoir 17 through line 16 by means of pump 18 with valve 22 being closed. During periods in which storage unit 13 is being filled with gas from compressor 10, liquid is displaced from storage unit 13 back to reservoir 17 through lines 16 and 21 when valve 22 is open.

Thus, when gas delivery to a vehicle connected to filling dispenser 15 is started, the gas pressure in storage unit 13 will fall. When this pressure falls to a preset minimum value, typically, 3000 psig, pump 18 is initiated by a natural gas pressure sensing means (not shown) and starts to transfer liquid from reservoir 19 to storage unit 13 at a rate that maintains the pressure in storage above the 3000 psig set value. Pump 18 stops transferring liquid at pressures first above this 3000 psig set valve range. As storage unit 13 becomes depleted in gas through multiple filling operations, the liquid level rises. At a level preset through upper level first displacing liquid sensing switch 19, compressor 10 starts and delivers gas to storage unit 13 through line 12 and to dispensing station 15 through line 14. When the storage gas pressure exceeds approximately selected value 3500 psig, let down valve 22, as part of a second natural gas pressure sensing means, permits displacing liquid to flow back from storage unit 13, via lines 16 and 21 to reservoir 19. Compressor 10 continues to operate until the liquid level in storage unit 13 falls to a level preset through lower level second displacing liquid sensing switch 20. At this level compressor 10 is stopped and valve 22 is closed.

The volume of storage provided in the storage and retrieval system hereinbefore described may be varied to suit the demand at a particular filling station by increasing the volume of the natural gas storage means.

In the above embodiment the storage means volume may be enhanced by increasing the number or size of storage unit 13.

As described, hereinbefore, a conventional fast fill system containing 80 $ft^3$ of compressed gas storage at 3600 psig contains a total volume of compressed gas of approximately 23,000 $ft^3$ with a usable inventory of 3000 $ft^3$. This conventional system can be replaced by the embodiment described hereinabove of the present invention using storage units totalling approximately 12 $ft^3$ of volume. This voluime provides 3000 $ft^3$ of available gas storage. The liquid reservoir storage means required may be of similar volume to the actual storage volume and thus the 12 $ft^3$ required may be supplied by a tank of approximately 100 gallons capacity. Transfer of displacing liquid from the reservoir to the storage cylinders may be provided by a pump means of approximately 4 gallons/min. capacity.

I claim:

1. A natural gas storage and retrieval system comprising: natural gas storage means adapted to receive and store natural gas under pressure and a natural gas displacing liquid under pressure;

means for feeding natural gas under pressure to said natural gas storage means whereby said stored displacing liquid is displaced;

means for feeding said displacing liquid under pressure to said natural gas storage means whereby said stored natural gas is displaced;

means for collecting said displaced natural gas;

a first natural gas pressure sensing means to initiate and terminate, over a present range of lower gas pressures within said storage means, said feeding of said displacing liquid by said means for feeding said displacing liquid to said storage means;

a second natural gas pressure sensing means to permit, at a preset maximum value of gas pressure within said storage means, displacement of said displacing liquid from said storage means by said natural gas under pressure;

a first displacing liquid sensing means to initiate said feeding of natural gas by said means for feeding natural gas to said natural gas storage means; and a second displacing liquid sensing means to terminate said feeding of natural gas by said means for feeding natural gas to said natural gas storage means.

2. System as claimed in claim 1 wherein said means for feeding said displacing liquid to said storage means comprises liquid storage means and means for feeding said liquid under pressure to said natural gas storage means from said liquid storage means.

* * * * *